US009099263B2

(12) United States Patent
Orrico

(10) Patent No.: US 9,099,263 B2
(45) Date of Patent: Aug. 4, 2015

(54) UNIVERSAL LOAD SWITCH

(75) Inventor: Mario M. Orrico, Chicago, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 336 days.

(21) Appl. No.: 13/392,681

(22) PCT Filed: Jul. 31, 2010

(86) PCT No.: PCT/US2010/044044

§ 371 (c)(1),
(2), (4) Date: Feb. 27, 2012

(87) PCT Pub. No.: WO2011/025625

PCT Pub. Date: Mar. 3, 2011

(65) Prior Publication Data

US 2012/0152713 A1 Jun. 21, 2012

Related U.S. Application Data

(60) Provisional application No. 61/238,360, filed on Aug. 31, 2009.

(51) Int. Cl.

| | |
|---|---|
| ***H01H 5/30*** | (2006.01) |
| ***H01H 13/18*** | (2006.01) |
| *H01H 1/20* | (2006.01) |
| *H01H 5/28* | (2006.01) |
| *H01H 13/36* | (2006.01) |
| *H01H 13/62* | (2006.01) |

(52) U.S. Cl.

CPC ..... *H01H 13/18* (2013.01); *H01H 5/30* (2013.01); *H01H 1/2008* (2013.01); *H01H 5/28* (2013.01); *H01H 13/365* (2013.01); *H01H 13/62* (2013.01)

(58) Field of Classification Search

CPC ..... H01H 1/2015; H01H 3/46; H01H 5/00; H01H 5/12; H01H 5/18; H01H 5/20; H01H 2001/0005; H01H 1/36; H01H 15/18; H01H 65/30; H01H 15/20; H01H 5/22; H01H 5/26; H01H 5/28; H01H 5/30

USPC ..... 200/447, 405, 16 R, 16 B, 16 C, 16 F, 200/48 KB, 400, 434, 439, 537–540, 554, 200/254, 530, 43.04, 243

See application file for complete search history.

(56) References Cited

U.S. PATENT DOCUMENTS

| | | | | |
|---|---|---|---|---|
| 2,598,856 | A * | 6/1952 | Swan et al. | 200/447 |
| 2,840,657 | A * | 6/1958 | Roeser | 200/448 |
| 3,624,332 | A * | 11/1971 | Van Benschoten et al. | 200/409 |

(Continued)

FOREIGN PATENT DOCUMENTS

| | | | |
|---|---|---|---|
| CN | 2354225 | Y | 12/1999 |
| CN | 2870120 | Y | 2/2007 |
| FR | 1289680 | A | 4/1962 |

OTHER PUBLICATIONS

ISR for PCT/US2010/044044 dated Nov. 4, 2010.

*Primary Examiner* — Edwin A. Leon
*Assistant Examiner* — Anthony R. Jimenez
(74) *Attorney, Agent, or Firm* — Lowe Hauptman & Ham LLP

(57) ABSTRACT

A universal load switch includes convex fixed terminal contacts and convex movable contacts selectively connectable electrically to the terminal contacts. Snap blades forcibly move the movable contacts toward and away from each of the terminal contacts.

29 Claims, 13 Drawing Sheets

(56) References Cited

U.S. PATENT DOCUMENTS

| | | | | |
|---|---|---|---|---|
| 3,668,347 | A * | 6/1972 | Korsgren | 200/447 |
| 4,086,455 | A | 4/1978 | Takahashi | |
| 4,634,820 | A * | 1/1987 | Noguchi | 200/16 A |
| 4,978,824 | A * | 12/1990 | Allen | 200/447 |
| 5,283,406 | A | 2/1994 | Olsen | |
| 6,483,058 | B2 | 11/2002 | Ehrensberger | |
| 6,642,823 | B2 * | 11/2003 | Passow | 335/132 |
| 2002/0148713 | A1 * | 10/2002 | Nickerson et al. | 200/447 |

* cited by examiner

UNIVERSAL LOAD SWITCH

CROSS-REFERENCE TO RELATED APPLICATIONS

The present application is national phase of PCT/US2010/044044 filed Jul. 31, 2010, and claims the benefits of U.S. Provisional Application Ser. No. 61/238,360 filed Aug. 31, 2009.

FIELD OF THE INVENTION

The present invention relates generally to electrical switches, and, more particularly, to limit switches, proximity switches and the like in which a cam, linear operator or other position adjustable device operates the switch to open or close the switch. The present invention pertains to switches known as snap switches.

BACKGROUND OF THE INVENTION

Electrical switches are used in many different types of devices to start a function, stop a function, adjust the rate or other performance of the function, etc. For example, trains, subways and other devices may have several switches positioned in various locations to sense or confirm operation of doors that open or close access openings. Some such switches are used in high voltage applications while others are used in low voltage applications. In the past, it has been necessary to provide different switch constructions for high power applications than for low power applications. It can be costly to manufacture and maintain adequate inventories of replacement switches for future service operations for manufacturers of the switches and for operators of the devices in which the switches are used.

Arcing between switch contacts can occur due to frequent and rapid opening and closing of the contacts, as well as due to other conditions under which the switch may have to operate. When arcing occurs, it can happen that the switch contacts become welded to each other. Breaking the welds to separate the welded contacts can be difficult, and until the condition is corrected or the switch is replaced, normal function of the devices in which the switch is installed is adversely affected. It is desirable to provide a switch with redundancy to continue operating in such damaged situations; and/or, to operate forcefully when opening the contacts to thereby break welds that may occur from arcing.

SUMMARY OF THE INVENTION

A universal load switch is provided with convex fixed terminal contacts and convex movable contacts selectively connectable electrically to the terminal contacts. Snap blades forcibly move the movable contacts toward and away from each of the terminal contacts.

In one aspect of one form thereof, a load switch is provided with opposed spaced terminals, terminal contacts on the opposed spaced terminals, and a contact blade assembly between the terminal contacts, the contact blade assembly including blade contacts. Snap blades forcibly moving the contact blade assembly toward and away from both of the terminals.

In another aspect of a form thereof, a load switch is provided with first and second spaced upper terminal contacts, first and second spaced lower terminal contacts, and a contact blade assembly have a first end disposed between the first upper contact and the first lower contact, and a second end disposed between the second upper contact and the second lower contact. Contacts of the contact blade assembly selectively engage the terminal contacts. A blade shuttle moves the contact blade assembly, and snap blades forcibly move the contact blade assembly toward and away from each of the first and second spaced upper and lower terminal contacts.

In another aspect of a form thereof, a load switch is provided with first upper and lower terminals having first upper and lower terminal contacts thereon, second upper and lower terminals having second upper and lower terminal contacts thereon, a plunger assembly and a blade shuttle assembly including a blade shuttle and a contact blade assembly disposed in the blade shuttle. The contact blade assembly has first and second ends between the first upper and lower terminals and the second upper and lower terminals, respectively. Upper and lower blade contacts are provided on opposite sides of the contact blade assembly at each of the first and second ends. Snap blades operatively arranged between the plunger assembly and the blade shuttle forcibly move the contact blade assembly toward and away from each of the upper and lower terminals.

Other features and advantages of the invention will become apparent to those skilled in the art upon review of the following detailed description, claims and drawings in which like numerals are used to designate like features.

Figure 1:
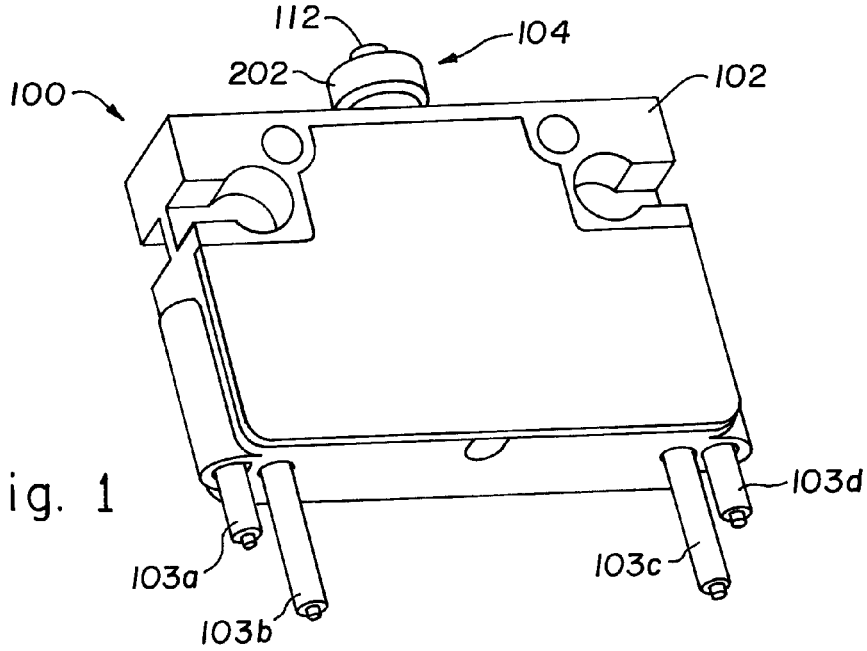
FIG. 1 is a perspective view of a universal load switch.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 3:
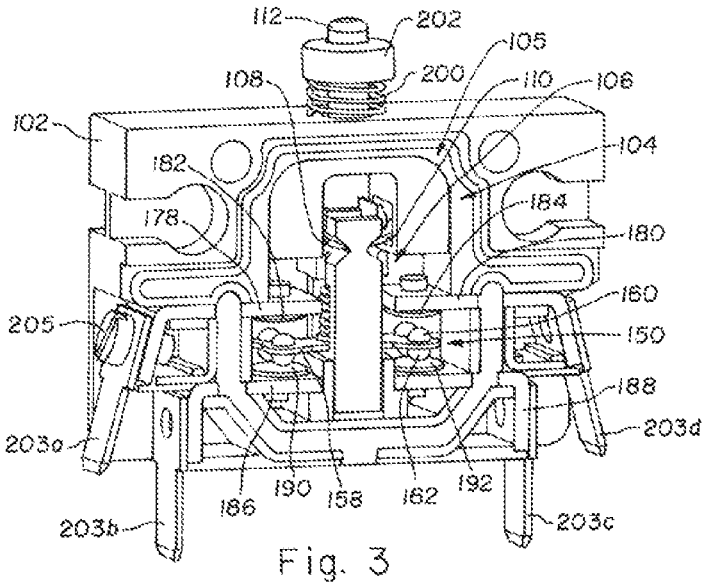
FIG. 3 is a perspective view of a universal load switch similar to that shown in FIGS. 1 and 2, but having alternate connection accessories.

Referring now more specifically to the drawings and to FIG. 1 in particular, a universal load switch 100 is shown. As shown in FIG. 1, universal load switch 100 includes a housing 102 to seal and protect the inner components of the switch mechanism to be described subsequently herein. Switch 100 can be connected within an electrical circuit in many different ways. By way of example and not limitation, wire leads 103 *a, b, c* and *d* can be connected to the switch by soldering, crimp connecting or other suitable electrical connection, as those skilled in the art will readily understand. An alternative construction is shown in FIG. 3 in which quick connect blade accessories 203*a-d* are provided in place of wire leads 103*a-d*. Quick connect blade accessories 203 *a-d* can be connected by welding, crimp connections, screws 205 (only one screw 205 being shown for exemplary purposes) or other suitable electrical connecting means to the switch.

For ease of description herein, and for clarity in the claims, the universal load switch will be described in the orientation shown in the drawings. Accordingly, terms such as "upper", "lower", "above", "below" and other terms that imply direction and relative orientation will be used. However, it should be understood that the switches described herein can be used in different orientations, such as upside down from the primary orientation shown in the drawings, lying flat, or oriented on an edge other than as shown in the drawings. The directional and spatial descriptors used herein are merely for ease and clarity in description, and are not intended as limiting.

Operating components of load switch 100 are contained within housing 102, except for the distal end of a plunger assembly 104 that protrudes from housing 102. As will be described subsequently herein, the distal end of plunger assembly 104 can be depressed for operating load switch 100.

Figure 2:
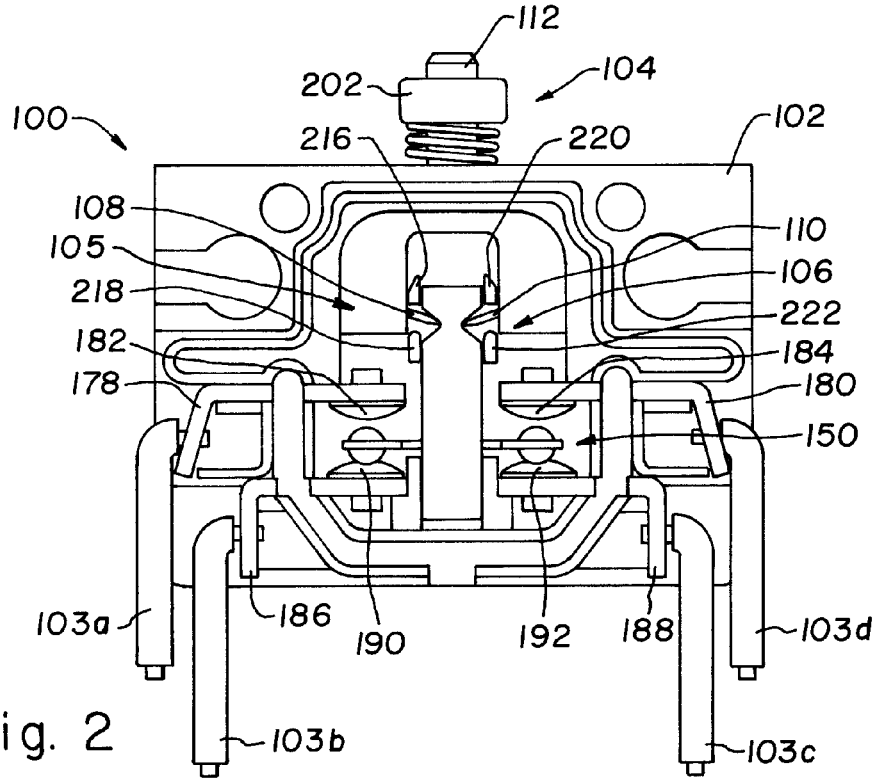
FIG. 2 is an elevational view of the universal load switch shown in FIG. 1, but having an outer housing cover removed to expose internal components of the universal load switch.

FIG. 2 illustrates universal load switch 100 with a cover or a side panel removed from housing 102 to expose the operating mechanisms of the switch within the switch housing. Switch 100 includes a butterfly assembly 105, which is comprised of plunger assembly 104, a blade shuttle assembly 106 and snap blades 108, 110 interconnecting plunger assembly 104 and blade shuttle assembly 106. Butterfly assembly 105 can be preassembled out of housing 102, and thereafter installed as a single unit or subassembly in switch 100, as will be described more fully hereinafter.

Figure 4:
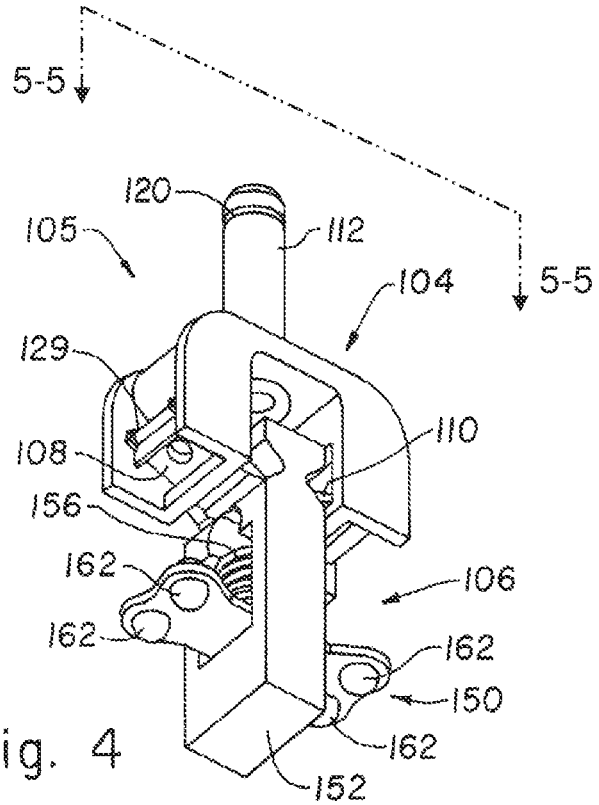
FIG. 4 is an enlarged perspective view of a subassembly in the universal load switch shown in the previous drawings.
Figure 5:
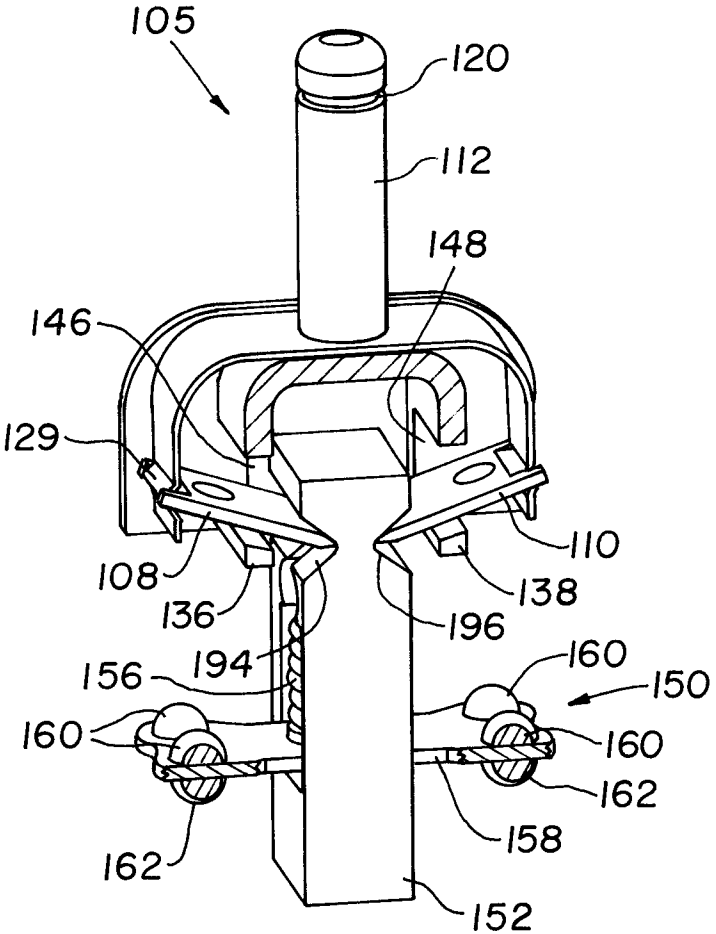
FIG. 5 is a cross-sectional view of the subassembly shown in FIG. 4 for the universal load switch.

FIG. 4 shows butterfly assembly 105 apart from the remaining structures of switch 100, and FIG. 5 is a cross-sectional view of butterfly assembly 105, more clearly showing plunger assembly 104 and blade shuttle assembly 106 interconnected by snap blades 108, 110. FIGS. 6-12 illustrate the component parts of butterfly assembly 105, including plunger assembly 104 and blade shuttle assembly 106.

Figure 6:
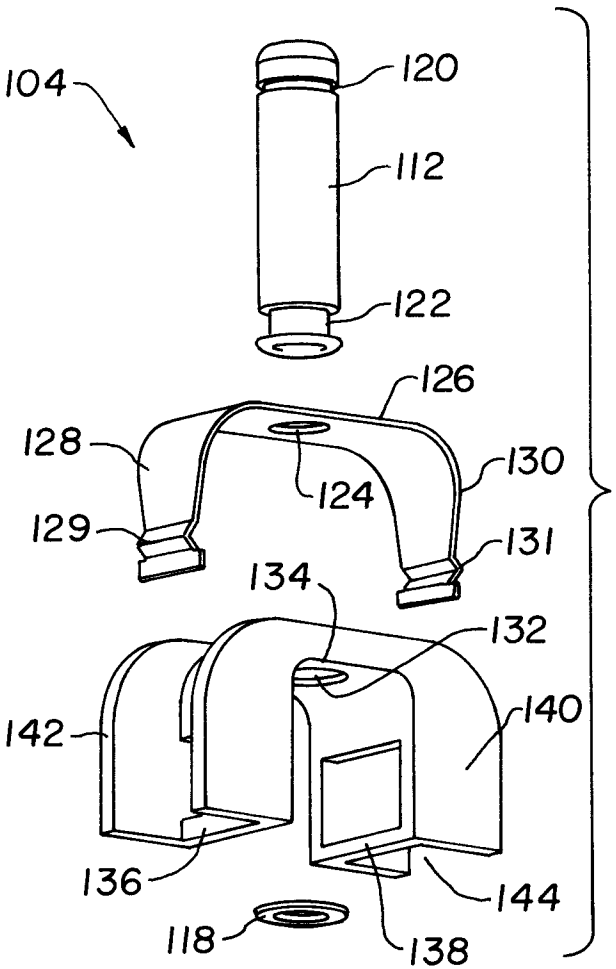
FIG. 6 is an exploded view of a plunger assembly for the universal load switch.

Referring now to the exploded view of plunger assembly 104 shown in FIG. 6, plunger assembly 104 includes a plunger 112, a C-spring 114, a guide 116 and a rollover washer 118. Plunger 112 is a cylindrical rod or shaft having a circumferential depression 120 at the external end thereof extending out of housing 102, and a circumferential channel 122 at the opposite or inner end thereof. C-spring 114 is, as the name implies, a C-shaped spring body having a hole 124 centrally located in a trunk portion 126 of the C-shaped body. First and second arms 128, 130 project from trunk portion 126 and include notched distal ends 129, 131, respectively. Guide 116 includes a hole 132 in a trunk 134 and arms 136, 138 projecting from opposite ends of trunk 134. Fore and aft flange plates 140, 142 project from the edges of trunk 134 and arms 136, 138. Accordingly, guide 116 generally defines a C-shaped channel 144 for receiving and supporting C-spring 114 in the completed assembly.

Figure 7:
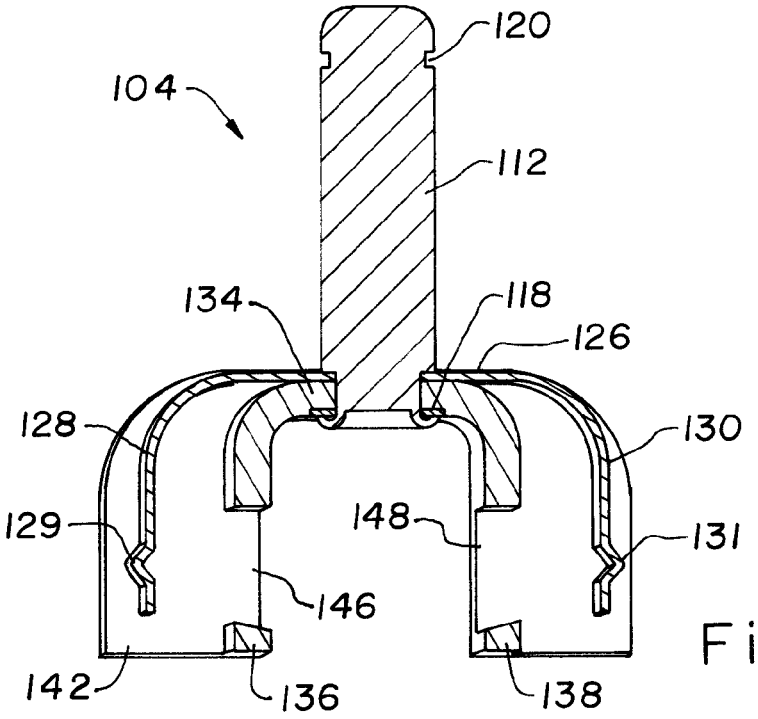
FIG. 7 is a cross-sectional view of the plunger assembly.

FIG. 7 is a cross-sectional view of the assembled plunger assembly 104. Plunger 112 is extended into holes 124 and 132 of C-spring 114 and guide 116, respectively. The peripheral edges defining holes 124, 132 are received in circumferential channel 122 of plunger 112, and rollover washer 118 is provided there against to hold the assembled spring 114 and guide 116 on plunger 112. As can be seen, arms 136, 138 define therein openings 146, 148 respectively.

Figure 8:
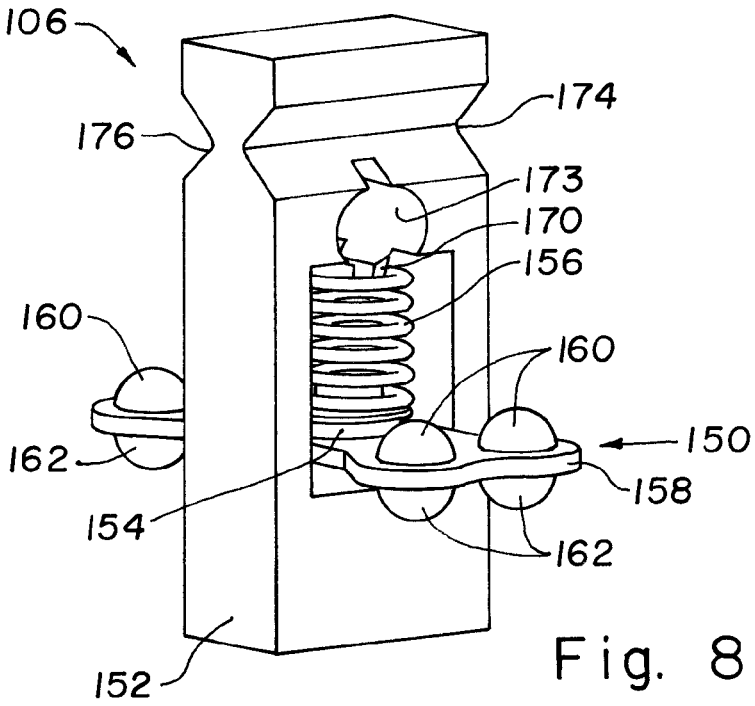
FIG. 8 is a perspective view of a blade shuttle assembly in the universal load switch.

FIG. 8 is a perspective view of blade shuttle assembly 106, which includes a contact blade assembly 150 held in a blade shuttle 152. A blade stay 154 and coil spring 156 are disposed to hold blade assembly 150 in blade shuttle 152.

Figure 9:
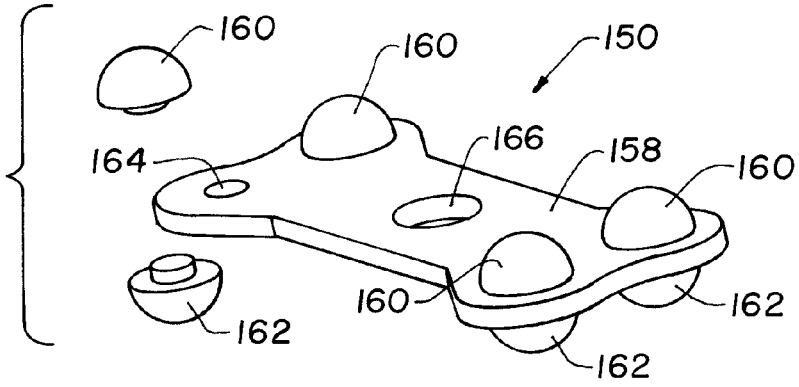
FIG. 9 is an exploded view of a blade assembly in a universal load switch.

FIG. 9 is an exploded view of blade assembly 150, which includes a contact blade 158 having upper contacts 160 and lower contacts 162 provided thereon. Four upper contacts 160 and four lower contacts 162 are provided in overlying alignment, extending through holes 164 defined in contact blade 158. Upper contacts 160 and lower contacts 162 are provided in pairs on opposite faces of contact blade 158, near opposite ends of contact blade 158. Silver contacts 160, 162 that preferably are convex or hemispherical in outer surface shape can be welded or staked to one another. When formed by staking, each contact has a primary head and a shank which extends through one of the holes 164 in contact blade 158, and during the staking process the distal end of the shank is pressed to form the opposite contact surface. A central aperture 166 is provided in contact blade 158.

Figure 10:
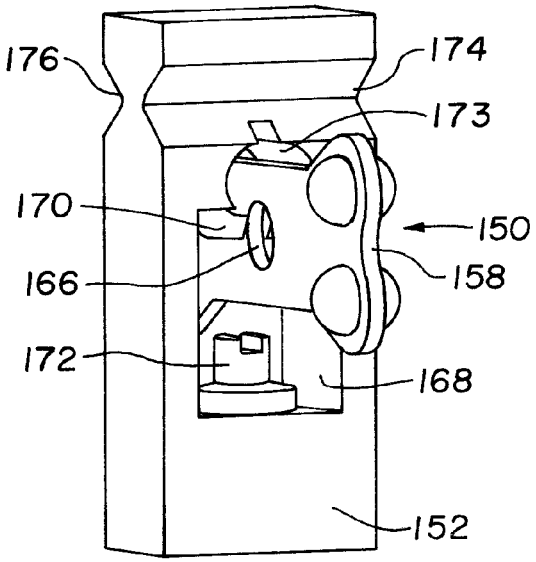
FIG. 10 is a perspective view illustrating an assembly step for installing the blade assembly in the blade shuttle.

FIG. 10 is a perspective view illustrating an assembly step for installing contact blade assembly 150 in blade shuttle 152. Blade shuttle 152 defines a window 168 extending therethrough and having upper and lower pedestals 170, 172 projecting toward each other, but spaced from each other in window 168. Contact blade assembly 150 is tilted on an edge and inserted into window 168. Upper and lower pedestals 170, 172 can be bifurcated as shown for upper pedestal 170 or can be channeled as shown for lower pedestal 172 to accommodate the width of contact blade 158 being inserted therethrough. A cylindrical opening 173 and other slots or openings can be provided through blade shuttle 152 to accommodate passing of contacts 160, 162 therethrough. In the exemplary embodiment, contact blade 158 is generally of a dog bone shape, having a narrower waist section at the middle thereof and wider sections containing upper and lower contacts 160, 162 at opposite ends of contact blade 158. Accordingly, with contact blade 158 centrally located in window 168, the contact blade can be rotated for placement over lower pedestal 172 such that lower pedestal 172 extends through central aperture 166.

Figure 11:
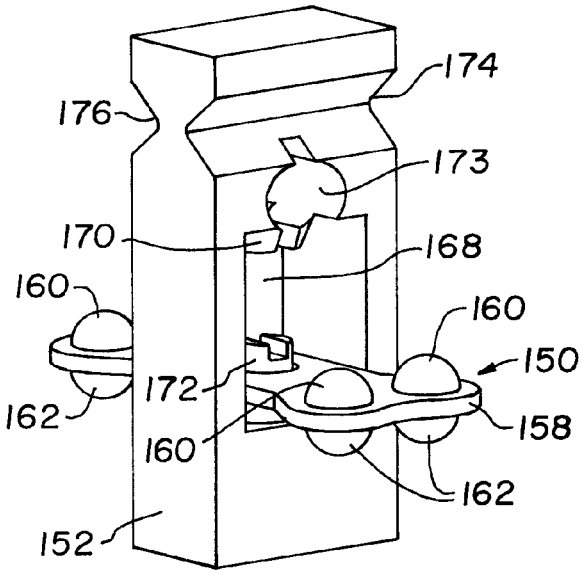
FIG. 11 is a perspective view illustrating a later assembly step for installing the blade assembly in the blade shuttle.

FIG. 11 is a perspective view illustrating a later assembly step for installing blade assembly 150 in blade shuttle 152. Aperture 166 is engaged with lower pedestal 172, with contact blade 158 extending outwardly of window 168 so that upper and lower contacts 160, 162 are exposed outwardly of blade shuttle 152 at both ends of contact blade 158. Thereafter, blade stay 154 is positioned over lower pedestal 172 and against contact blade 158, and coil spring 156 is compressed and inserted into window 168.

Figure 12:
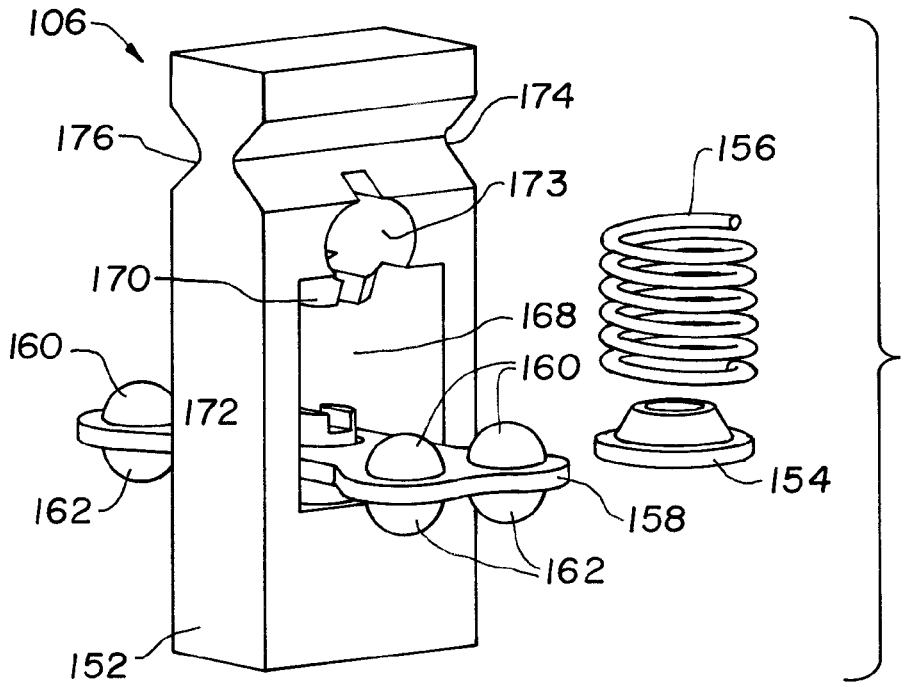
FIG. 12 is an exploded view of the blade shuttle assembly.

FIG. 12 is an exploded view of blade shuttle assembly 106, better showing blade stay 154 and spring 156. In the completed assembly, blade stay 154 is engaged over lower pedestal 172 and against contact blade 158. Spring 156 is engaged over a truncated conical end of blade stay 154 at the lower end of spring 156 and over upper pedestal 170 and against the upper end of window 168 at the upper end of spring 156. Accordingly, blade assembly 150 is held yieldingly in blade shuttle 152 by the biasing force of spring 156 there against, and can tilt or twist against the force of spring 156.

Above window 168, blade shuttle 152 defines V-channels 174, 176 extending inwardly from opposite surfaces. In the completed assembly of switch 100, snap blades 108, 110 are angularly disposed between and held in V-channels 174, 176 and shaped distal ends of arms 129, 131 of C-spring 114. Accordingly, snap blades 108, 110 extend through openings 146, 148 defined in guide 116 and interconnect plunger assembly 104 with blade shuttle assembly 106.

In the assembled switch, housing 102 also contains fixed, upper, normally open terminals 178, 180 having silver terminal contacts 182, 184, respectively, provided above the pairs of upper contacts 160 at opposite ends of contact blade 158, and fixed, lower, normally closed terminals 186, 188 having silver terminal contacts 190, 192 provided below the pairs of lower contacts 162 at opposite ends of contact blade 158. Terminal contacts 182, 184, 190, 192 preferably also are convex or hemispherical in outer surface shape.

Figure 13:
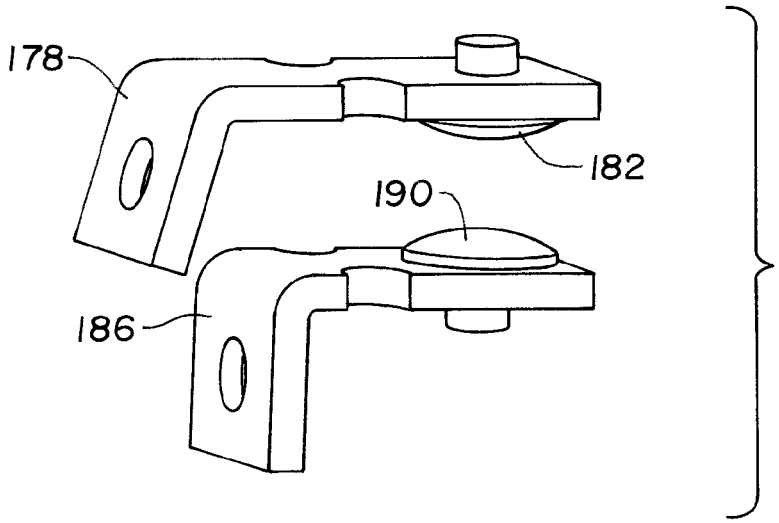
FIG. 13 is an enlarged view of a set of terminals for the universal load switch.

FIG. 13 is an enlarged view of one set of terminals, including upper terminal 178 and lower terminals 186 having terminal contacts 182, 190, respectively. It should be understood that the other pair of upper and lower contacts is constructed substantially the same as those shown in FIG. 13. Terminals 178, 180, 186, 188 can be adapted easily for attachment to various different types of electrical conductors including the aforementioned soldered connections, screw connections, snap or sliding connections and the like, including the aforedescribed wire leads 103*a-d* or quick connect of blade accessories 203*a-d*.

Figure 14:
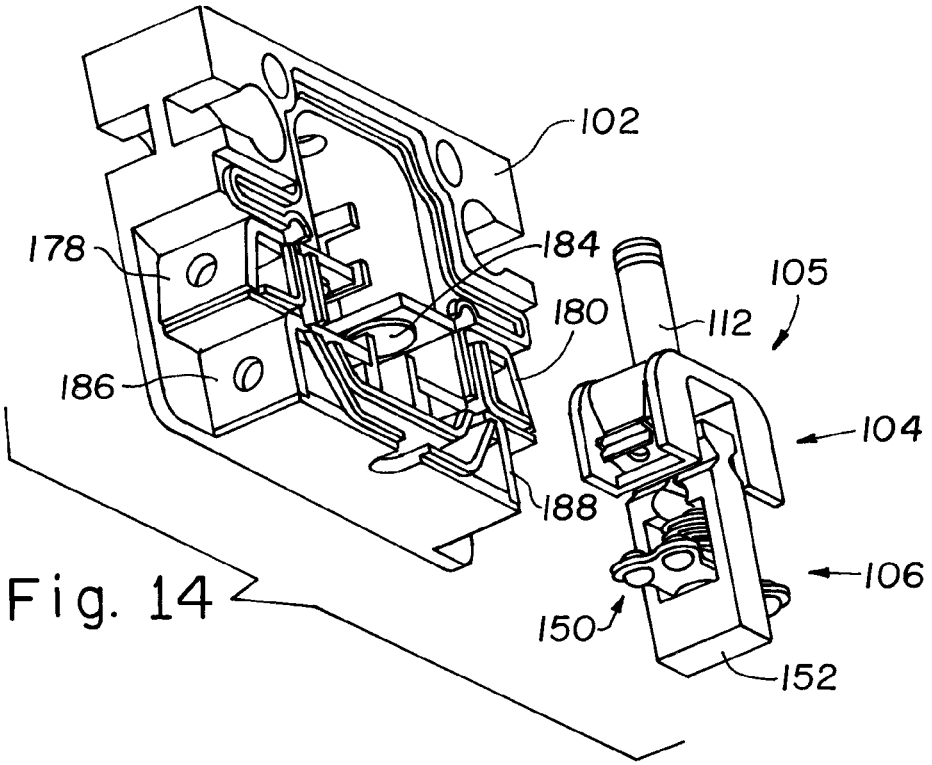
FIG. 14 is a perspective view of the butterfly assembly fully assembled and ready for installation in the housing and terminal assembly.

FIG. 14 is a perspective view of butterfly assembly 105 fully assembled and ready for installation in housing 102, which has terminals 178, 180, 186, 188 installed therein.

Figure 15:
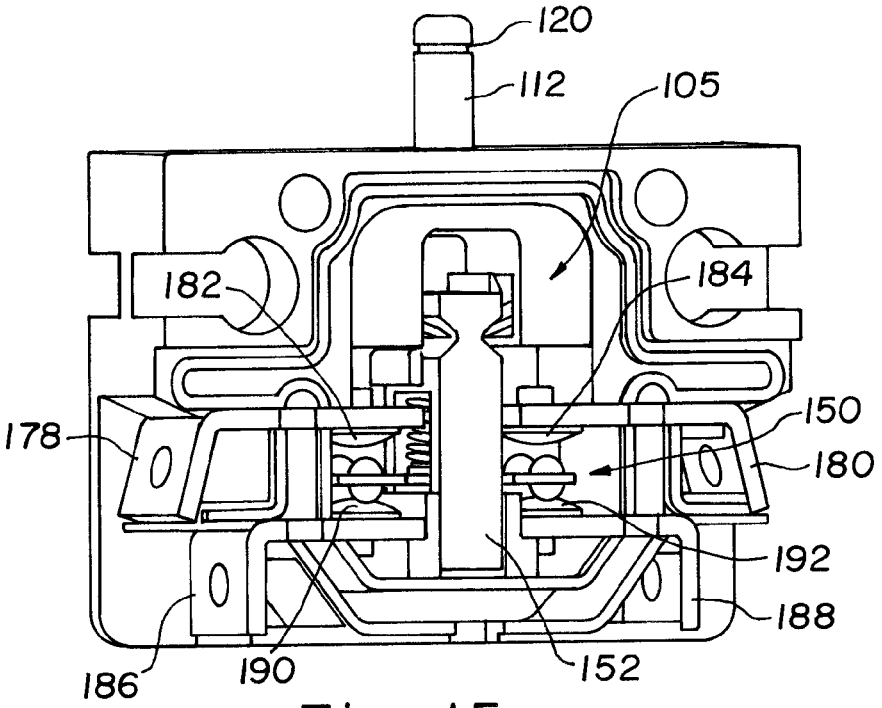
FIG. 15 is a perspective view of the butterfly assembly fully installed in the universal load switch housing.

FIG. 15 is a perspective view of the butterfly assembly 105 fully seated within housing 102. The upper and lower contacts 182, 184, 190, 192 of the preinstalled terminals 178, 180, 186, 188 are positioned above and below the contacts 160, 162 on contact blade 158 of butterfly assembly 105.

Figure 16:
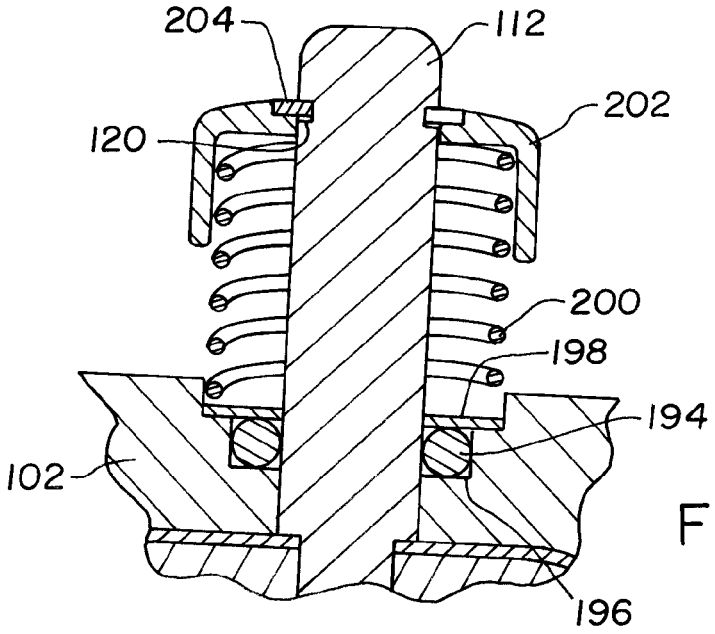
FIG. 16 is an enlarged, fragmentary cross-sectional view of a distal end of the plunger in the universal load switch.

FIG. 16 illustrates components for final assembly at the distal end of plunger 112. An O-ring 194 is seated in a groove 196 in housing 102 that is provided around plunger 112. A washer 198 and a return spring 200 are placed over the distal end of plunger 112. A spring cap 202 and lock ring 204 are next installed over the distal end of plunger 112, with lock ring 204 seated in circumferential depression 120, thereby holding return spring 200 in operating position between housing 102 and spring camp 202.

Figure 17:
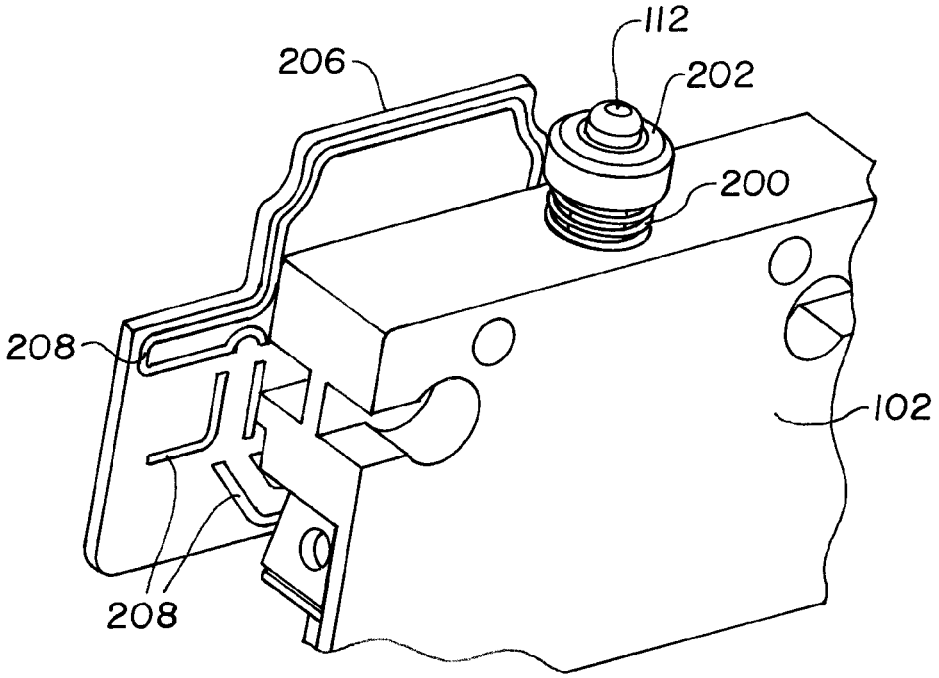
FIG. 17 is a view of the universal load switch.
Figure 18:
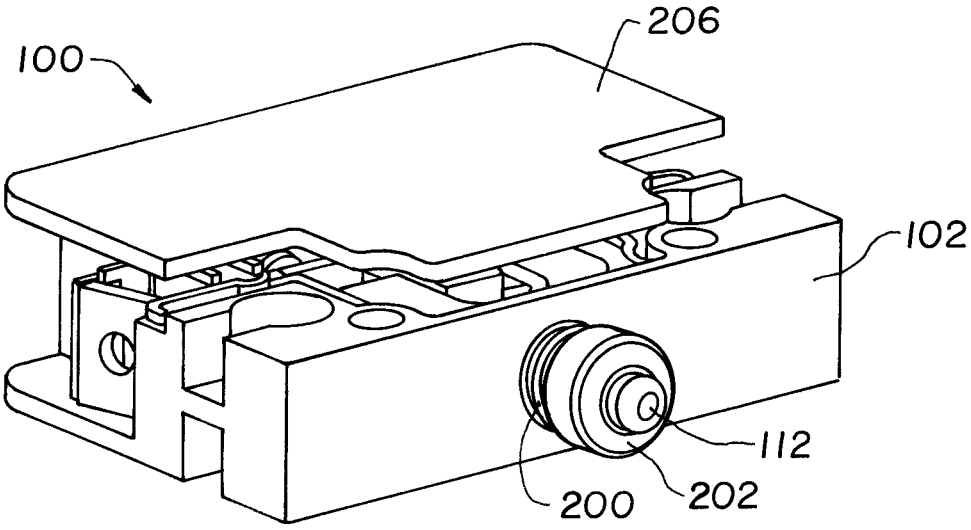
FIG. 18 is a view of the universal load switch shown from a different angle than that shown in FIG. 17.
Figure 19:
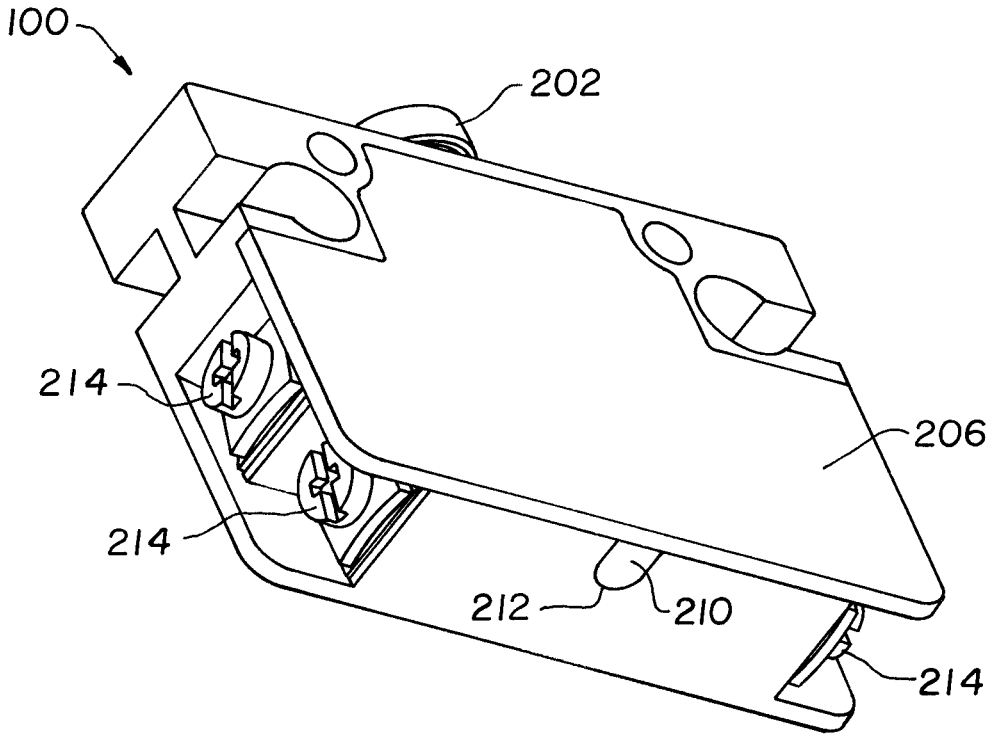
FIG. 19 is a perspective view of the universal load switch.

FIGS. 17 and 18 illustrate a step in the completion of housing 102 from different angles. A cover piece 206 having weld grooves 208 is positioned over the open switch assembly. FIG. 19 illustrates the switch after the cover has been sonically welded in place. To provide an environmentally sealed switch, seal compound 210 is injected through a seal port 212 in housing 102. Terminal screws 214 are shown attached to the terminals.

Figure 20:
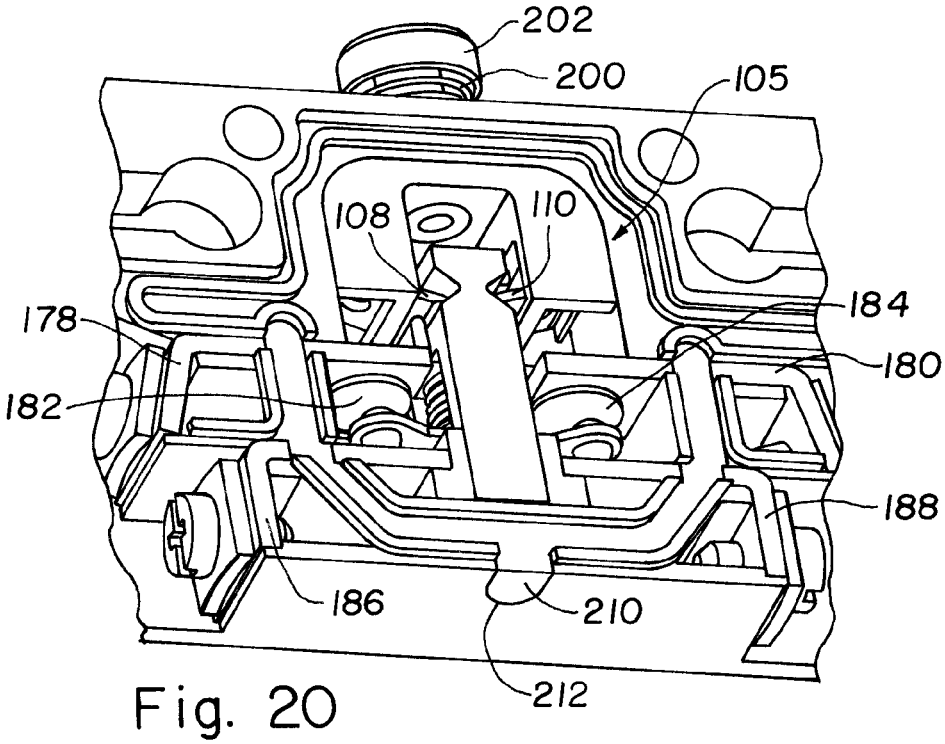
FIG. 20 is a fragmentary view of a fully assembled a universal load switch without the housing cover being shown.

FIG. 20 shows further detail of the flow of seal compound 210 within the switch 100.

In the assembled condition for switch 100, snap blade 108 is disposed between an upper blade wedge 216 and a lower blade wedge 218, and snap blade 110 is disposed between an upper blade wedge 220 and a lower blade wedge 222. Blade wedges 216, 218, 220, 222 operate together with the movement of butterfly assembly 105 to impart forced movement of contact blade 158 in both directions via snap blades 108, 110. Blade wedges 216, 218, 220, 222 can be integral formations created during molding of load switch housing 102. Accordingly, blade wedges 216, 218, 220, 222 are rigid and strong.

Figure 21:
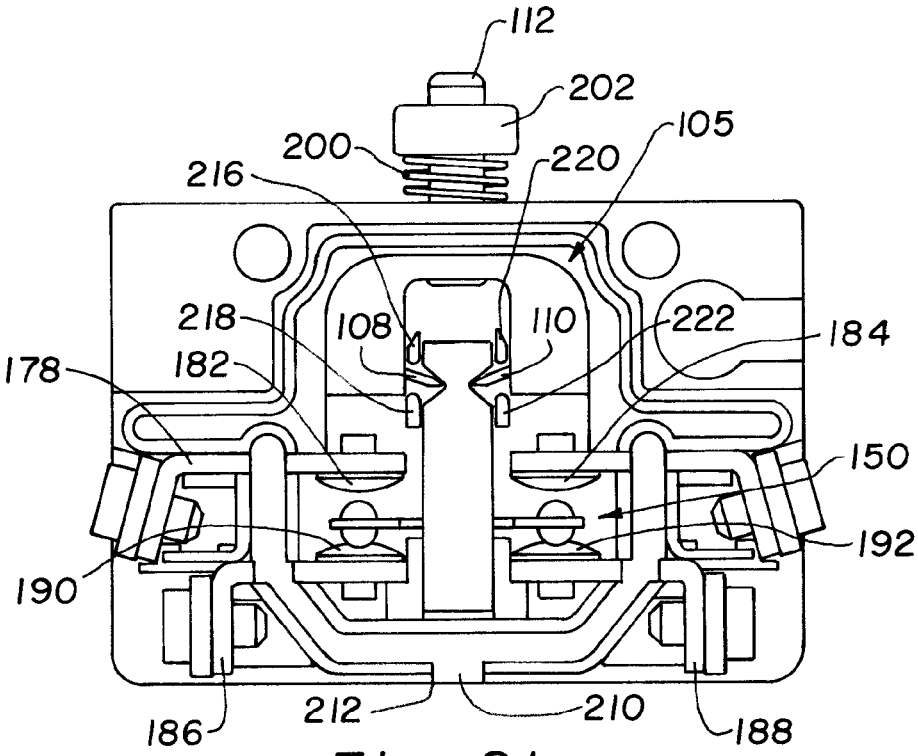
FIG. 21 is an elevational view showing the universal load switch in a so-called "free position"

FIG. 21 illustrates switch 100 in a so-called "free position." The normally closed lower terminals 186, 188 are in contact with lower contacts 162 of contact blade assembly 150. Two of the lower contacts 162 at one end of contact blade 158 are in electrical contact with lower terminal contact 190 of lower terminal 186 and two lower contacts 162 at the opposite end of contact blade 158 are in electrical contact with lower terminal contact 192 of lower terminal 188.

Figure 22:
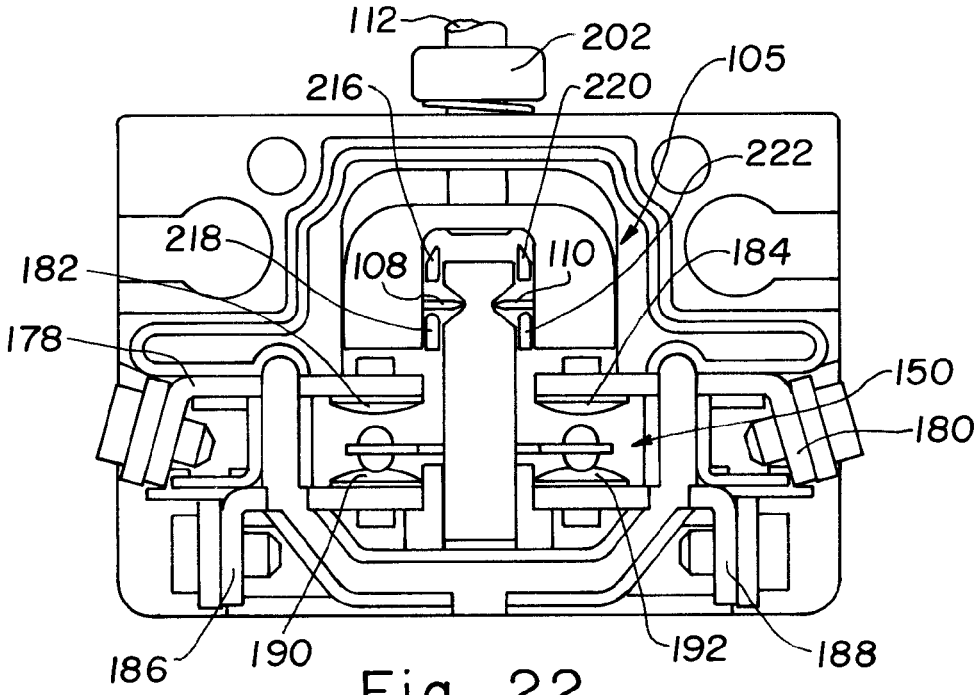
FIG. 22 is an elevational view illustrating the universal load switch at an operating condition with the plunger depressed.

FIG. 22 illustrates switch 100 at an operating condition with plunger 112 having been depressed. Snap blades 108, 110 which extend angularly outwardly and upwardly from grooves 174, 176 toward the shaped, notched distal ends 129, 131 of spring 114 in the free position have been flattened in the operating condition when plunger 112 has been depressed, which in turn moves all of plunger assembly 104 downwardly. The flat blades 108, 110 are ready to snap the mechanism to a second position by elevating blade shuttle assembly 106. If the contacts have become welded due to load and arcing, snap blades 108, 110 wedge and force transfer, to break the welds. The C-spring provides transfer snap by loading the snap blades inwardly.

Figure 23:
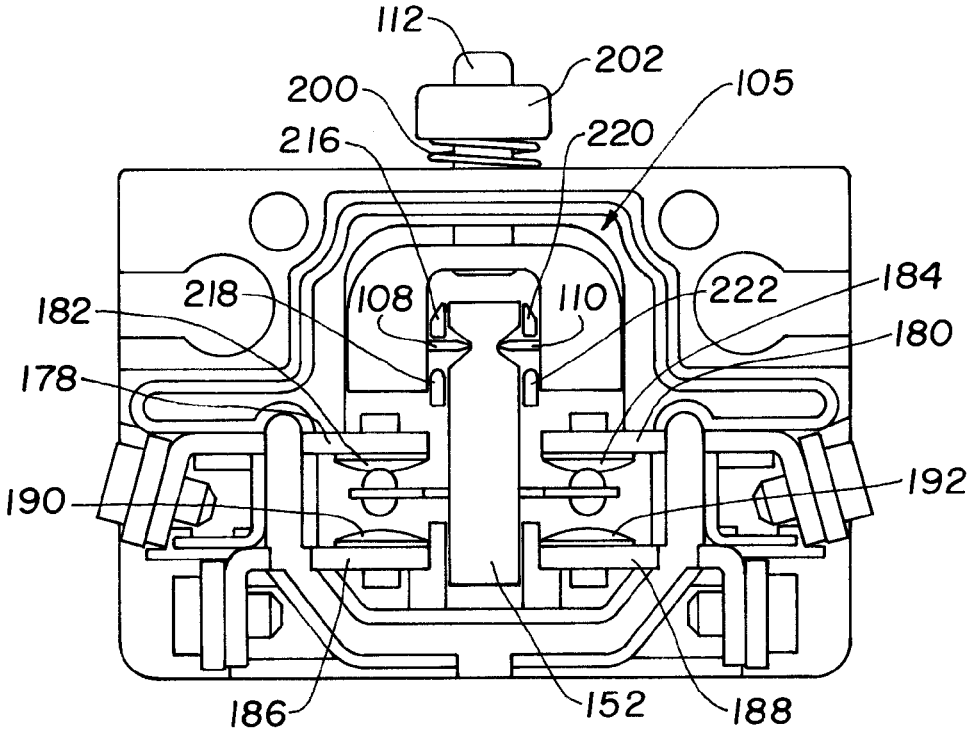
FIG. 23 is an elevational view illustrating the universal load switch in a so-called "reset" condition.

FIG. 23 illustrates switch 100 in a so-called "reset" position in which upper contacts 160 are in electrical contact with upper terminal contacts 182, 184 of upper terminals 178, 180. Plunger 112 has been released, and is returned to its elevated position by return spring 200, thereby raising all of shuttle assembly 104. Two upper contacts 160 at one end of contact blade 158 are in electrical contact with upper terminal contact 182 of upper terminal 178 and two upper contacts 160 at the opposite end of contact blade 158 are in electrical contact with upper terminal contact 184 of upper terminal 180. Blade shuttle 152 has been elevated so as to elevate contact blade 158 toward upper terminals 178, 180 to place the pairs of upper contacts 160 against the upper terminal contacts 182, 184

Figure 24:
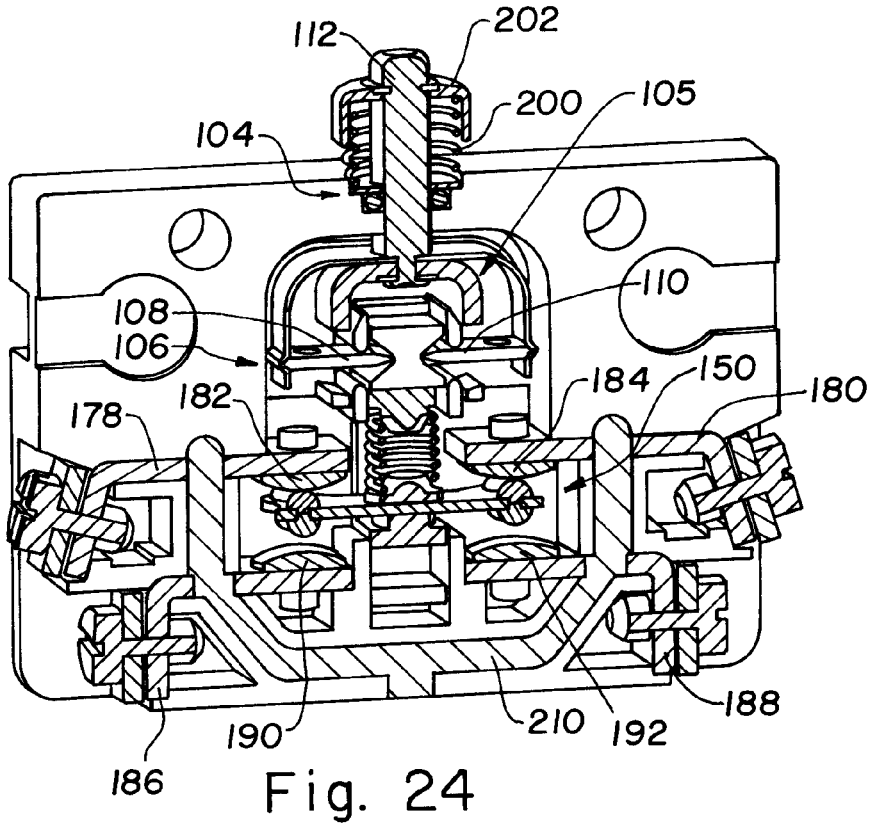
FIG. 24 is a cross-sectional view of the universal load switch at the reset condition shown in FIG. 23.

FIG. 24 is a cross-sectional view of the switch at the reset position, as shown in FIG. 23.

Figure 25:
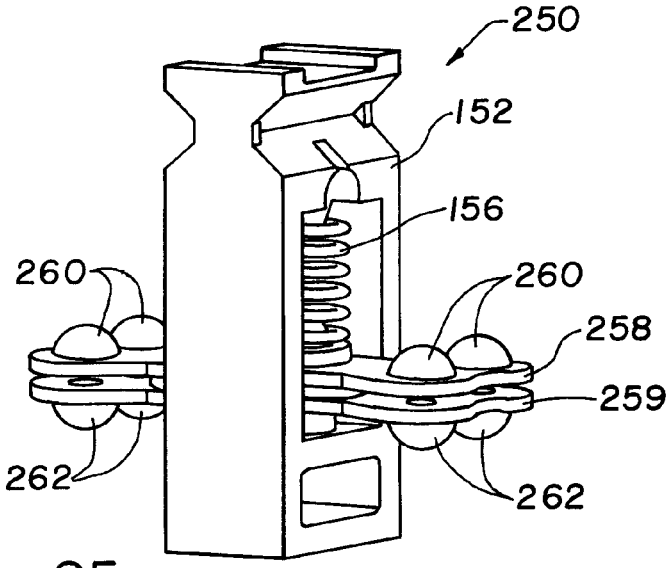
FIG. 25 is a perspective view of a second embodiment for the blade shuttle assembly in a universal load switch.

FIG. 25 is a perspective view of a modification for the blade shuttle assembly. A contact blade assembly 250 thereof includes electrically isolated upper and lower contact blades 258, 259. Insulation material can be provided between upper and lower contact blades 258, 259. Upper contacts 260 are installed in upper contact blade 258 and lower contacts 262 are installed in lower contact blade 259. Even if one side of the switch assembly becomes welded in either the upper or lower contact configuration such that only the opposite side operates, cross continuity does not occur because of the electrical isolation of the upper and lower contacts.

Figure 26:
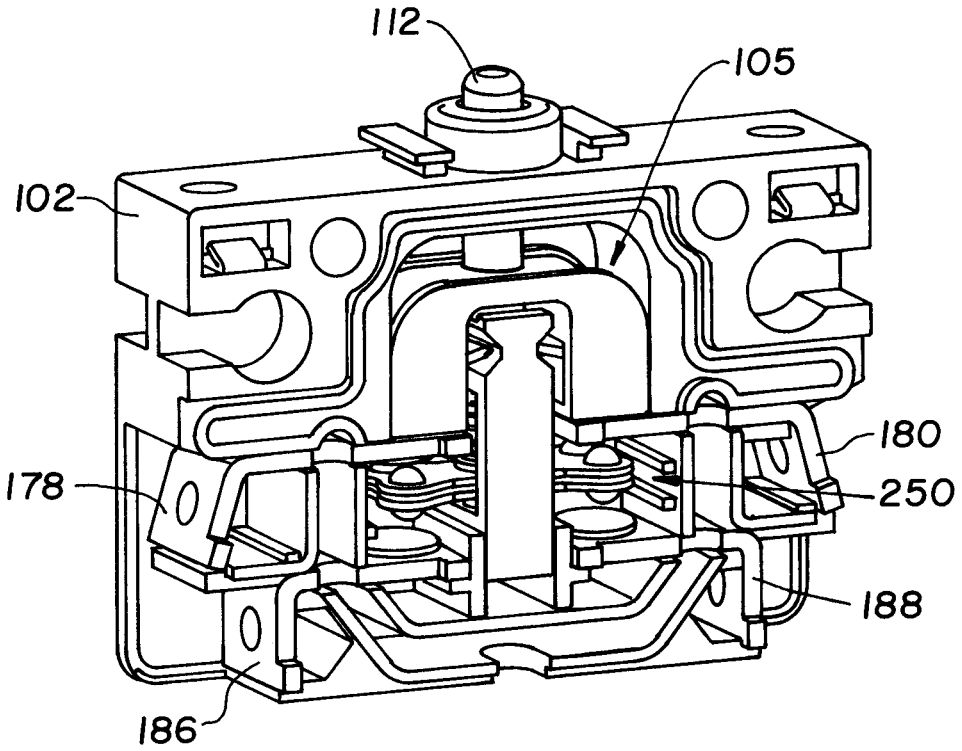
FIG. 26 is a perspective view of the blade shuttle assembly shown in FIG. 25 installed in a completed switch.

FIG. 26 illustrates installation of the double blade assembly in a switch 300. The other components of switch 300 are similar to those described previously herein with respect to switch 100 and are identified with the same reference numbers.

The various contacts described herein, including upper contacts 160, 260 lower contacts 162, 262 and upper and lower terminal contacts 182, 184, 190, 192 preferably are solid silver contacts, or other high-grade electrically conductive material. In preferred embodiments therefore, contacts 160, 162, 182, 184, 190, 192, 260, 262 are each of convex outer shape to provide some sliding contact one against the other when electrical contact is established. Since contact blade 158 is spring mounted, some flexibility is provided whereby contact blade 158 self-adjusts while placing either upper contacts 160 thereof or lower contacts 162 thereof against upper terminal contacts 182, 184 or lower terminal contacts 190, 192.

Advantages are achieved with switches in accordance with the present invention. Redundant contact points are established for each terminal contact with either two upper contacts 160 or two lower contacts 162 from contact blade assembly 150 establishing electrical contact against a terminal contact 182, 184, 190 or 192. Using solid silver contacts allows the same switch configuration to be adaptable to low-level power applications and to high power applications. By providing convex or hemispherical contact surfaces for the stationary contact, and with the contact blade being allowed to randomly adapt to it, forces a certain amount of sliding at the point of contact while the contact is being established. Micro-sliding of the contacts is desirable for reliability by providing a micro-scouring action as the various contact surfaces slide against one another. The biasing configuration of the springs, snap blades and blade wedges provides a forced contact break in both directions. The switch therefore has high end adaptability for many uses, including handling high load levels, handling logic level loads, being totally sealed to the environment, configurable to use with multiple termination types while providing forced break in both transfer directions for added reliability.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A load switch, comprising:
opposed spaced terminals;
terminal contacts on said opposed spaced terminals;
a contact blade assembly between said terminal contacts, said contact blade assembly including blade contacts; and
snap blades forcibly moving said contact blade assembly toward and away from both of said terminals,
wherein the load switch further includes a blade shuttle moving said contact blade assembly between said opposed spaced terminals, said contact blade assembly being spring mounted in said blade shuttle.

2. The load switch of claim 1, said terminal contacts and said blade contacts having convex surfaces.

3. The load switch of claim 2, including two said blade contacts for each said terminal contact.

4. The load switch of claim 1, including opposed terminals having terminal contacts on opposite sides of said contact blade assembly at each of first and second ends of said contact blade assembly.

5. The load switch of claim 4, said terminal contacts and said blade contacts having convex surfaces.

6. The load switch of claim 4, including two said blade contacts for each said terminal contact.

7. The load switch of claim 6, said contact blade assembly having electrically isolated first and second contact blades each having some of said blade contacts thereon.

8. The load switch of claim 1, including two said blade contacts for each said terminal contact.

9. A load switch, comprising:
first and second spaced upper terminal contacts;
first and second spaced lower terminal contacts;
a contact blade assembly have a first end disposed between said first upper contact and said first lower contact, and a second end disposed between said second upper contact and said second lower contact; contacts of said contact blade assembly for selective engagement with said terminal contacts;
a blade shuttle for moving said contact blade assembly; and
snap blades forcibly moving said contact blade assembly toward and away from each of said first and second spaced upper and lower terminal contacts,
wherein the contact blade assembly includes a contact blade located a spaced distance from all of the snap blades.

10. The load switch of claim 9, said contact blade assembly including two contacts for each of said upper and lower terminal contacts.

11. The load switch of claim 10, said upper and lower terminal contacts having convex surfaces.

12. The load switch of claim 11, said contacts of said contact blade assembly having convex surfaces.

13. The load switch of claim 9, said contacts of said contact blade assembly having convex surfaces.

14. The load switch of claim 9, said contact blade assembly including first and second electrically isolated contact blades, and some of said contacts of said contact blade assembly being disposed on each of said first and second electrically isolated contact blades.

15. A load switch comprising:
first upper and lower terminals having first upper and lower terminal contacts thereon;
second upper and lower terminals having second upper and lower terminal contacts thereon;
a plunger assembly;
a blade shuttle assembly including a blade shuttle and a contact blade assembly disposed in said blade shuttle; said contact blade assembly having first and second ends between said first upper and lower terminals and said second upper and lower terminals, respectively;

upper and lower blade contacts on opposite sides of said contact blade assembly at each of said first and second ends; and snap blades operatively arranged between said plunger assembly and said blade shuttle for forcibly moving said contact blade assembly toward and away from each of said upper and lower terminals, wherein the contact blade assembly includes a contact blade, wherein the load switch is configured such that the snap blades rotate to forcibly move said contact blade assembly, and wherein the load switch is configured such that the contact blade is rotationally stationary when the snap blades rotate to forcibly move said contact blade assembly.

16. The load switch of claim 15, including two upper blade contacts and two lower blade contacts at each of said first and second ends of said contact blade.

17. The load switch of claim 15, said terminal contacts and said upper and lower blade contacts having convex outer surfaces.

18. The load switch of claim 17, including two upper blade contacts and two lower blade contacts for each of said first and second ends of said contact blade.

19. The load switch of claim 15, said contact blade assembly including first and second electrically isolated contact blades, said upper blade contacts being disposed on said first contact blade and said lower blade contacts being disposed on said second contact blade.

20. The load switch of claim 1, wherein the contact blade assembly includes at least one contact blade, wherein at least one of the snap blades has a thickness at least about the same as a thickness of the contact blade.

21. The load switch of claim 1, wherein at least one of the snap blades is substantially straight with respect to lateral and longitudinal extension.

22. The load switch of claim 1, wherein the load switch is configured such that the geometry of the snap blades remain substantially constant during movement of said contact blade assembly toward and away from both of said terminals.

23. The load switch of claim 1, wherein the snap blades are mounted to a spring at one end thereof and a blade shuttle at an opposite end thereof, the blade shuttle supporting the contact blade assembly, wherein the load switch is configured to force at least portions of the spring at the location where the snap blades are mounted away from the blade shuttle during movement of said contact blade assembly towards one of said terminals, and wherein the load switch is configured such that the spring forces at least portions of the spring at the location where the snap blades are mounted toward the blade shuttle during movement of said contact blade assembly towards the other of said terminals.

24. The load switch of claim 1, wherein the load switch is configured such that the respective blade contacts are offset relative to respective terminal contacts.

25. The load switch of claim 1, wherein the load switch is configured such that respective blade contacts form valleys into which respective terminal contacts enter as a result of movement of said contact blade assembly.

26. The load switch of claim 1, wherein the contact blade assembly includes a contact blade located a spaced distance from all of the snap blades.

27. The load switch of claim 15, wherein the contact blade assembly includes a contact blade located a spaced distance from all of the snap blades.

28. The load switch of claim 1, wherein the contact blade assembly includes a contact blade, wherein the load switch is configured such that the snap blades rotate to forcibly move said contact blade assembly, and wherein the load switch is configured such that the contact blade is rotationally stationary when the snap blades rotate to forcibly move said contact blade assembly.

29. The load switch of claim 9, wherein the contact blade assembly includes a contact blade, wherein the load switch is configured such that the snap blades rotate to forcibly move said contact blade assembly, and wherein the load switch is configured such that the contact blade is rotationally stationary when the snap blades rotate to forcibly move said contact blade assembly.

* * * * *